US005340692A

United States Patent [19]

Vermeulen et al.

[11] Patent Number: 5,340,692

[45] Date of Patent: Aug. 23, 1994

[54] IMAGE RECEIVING MATERIAL WITH NACREOUS PIGMENT FOR PRODUCING CONTONE IMAGES ACCORDING TO THE SILVER SALT DIFFUSION TRANSFER PROCESS

[75] Inventors: Leon Vermeulen, Herenthout; Robert Pauwels, Brasschaat, both of Belgium

[73] Assignee: Agfa-Gevaert, N.V., Mortsel, Belgium

[21] Appl. No.: 120,177

[22] Filed: Sep. 13, 1993

[30] Foreign Application Priority Data

Sep. 14, 1992 [EP] European Pat. Off. ..... 92202798.2

[51] Int. Cl.[5] ..... G03C 5/54

[52] U.S. Cl. ..... 430/233; 430/227; 430/230; 430/231; 430/244; 430/248; 430/965

[58] Field of Search ..... 430/227, 231, 230, 233, 430/220, 244, 247, 965, 248

[56] References Cited

U.S. PATENT DOCUMENTS

| | | | |
|---|---|---|---|
| 3,705,804 | 12/1972 | Farney et al. | 430/231 |
| 3,985,561 | 10/1976 | De Haes et al. | 430/230 |
| 4,242,436 | 12/1980 | Mertens et al. | 430/230 |
| 4,288,524 | 9/1981 | Bilofsky et al. | 430/220 |
| 4,859,566 | 8/1989 | De Keyzer | 430/231 |

*Primary Examiner*—Richard L. Schilling
*Attorney, Agent, or Firm*—Breiner & Breiner

[57] ABSTRACT

The present invention provides an image receiving material comprising on a support an image receiving layer containing physical development nuclei characterised in that said image receiving material contains a nacreous pigment in said image receiving layer and/or in an optional layer between said support and said image receiving layer. Excellent contone images with an antique look can be obtained with such an image receiving material in a silver salt diffusion transfer process.

8 Claims, No Drawings

IMAGE RECEIVING MATERIAL WITH NACREOUS PIGMENT FOR PRODUCING CONTONE IMAGES ACCORDING TO THE SILVER SALT DIFFUSION TRANSFER PROCESS

DESCRIPTION

1. Field of the Invention

The present invention relates to an image receiving material for obtaining contone images according to the silver salt diffusion transfer process.

2. Background of the Invention

The principles of the silver complex diffusion transfer reversal process, hereinafter also called DTR-process have been described e.g. in the U.S. Pat. No. 2,352,014 of André Rott issued Jun. 20, 1944.

In the DTR-process, silver complexes are image-wise transferred by diffusion from a silver halide emulsion layer to an image-receiving layer, where they are converted, in the presence of development nuclei, into a silver image. For this purpose, an image-wise exposed silver halide emulsion layer is developed by means of a developing substance in the presence of a so-called silver halide solvent. In the exposed parts of the silver halide emulsion layer the silver halide is developed to metallic silver so that it cannot dissolve anymore and consequently cannot diffuse. In the non-exposed parts of the silver halide emulsion layer the silver halide is developed to metallic silver is converted into soluble silver complexes by means of a silver halide complexing agent (a so called silver halide solvent) and transferred by diffusion to an adjacent image-receiving layer or to an image-receiving layer brought into contact with the emulsion layer to form, in the presence of development nuclei, a silver, or silver-containing image in the image-receiving layer. More details on the DTR-process can be found in "Photographic Silver Halide Diffusion Processes" by A. Rott and E. Weyde, Focal Press, London, N.Y. (1972).

The DTR process can be utilized in a wide field such as reproduction of documents, making of printing plates, preparation of block copies, and instant photography. The DTR-process can be used for reproducing line originals as well as continuous tone originals.

The reproduction of continuous tone images by the DTR-process requires the use of a recording material capable of yielding images with considerable lower gradation than is normally applied in document reproduction to ensure the correct tone rendering of continuous tones of the original. In document reproduction silver halide emulsion materials are used which normally mainly contain silver chloride. Silver chloride not only leads to a more rapid development but also to high contrast.

In the U.S. Pat. No. 3,985,561 a light-sensitive silver halide material is described wherein the silver halide is predominantly chloride and this material is capable of forming a continuous tone image on or in an image-receiving material by the diffusion transfer process.

According to said U.S. patent a continuous tone image is produced by the diffusion transfer process in or on an image-receiving layer through the use of a light-sensitive layer which contains a mixture of silver chloride and silver iodide and/or silver bromide dispersed in a hydrophillic colloid binder e.g. gelatin, wherein the silver chloride is present in an amount of at least 90 mole % based on the total mole of silver halide and wherein the weight ratio of hydrophillic colloid to silver halide, expressed as silver nitrate, is between 3:1 and about 10:1 by weight.

With these light-sensitive materials successful reproduction of continuous tone images can be obtained probably as a result of the presence of the indicated amounts of silver iodide and/or silver bromide and of the defined high ratio of hydrophillic colloid to silver halide.

According to U.S. Pat. No. 4,242,436 the reproduction of continuous tone images can be improved by developing the photographic material by a mixture of developing agents comprising an o-dihydroxybenzene, e.g. catechol, a 3pyrazolidinone e.g. a 1-aryl-3-pyrazolidinone and optionally a p-dihydroxybenzeneo, e.g. hydroquinone the molar amount of the o-dihydroxybenzene in said mixture being larger than the molar amount of the 3-pyrazolidinone, and the p-dihydroxybenzene if any being present in a molar ratio of at most 5% with respect to the o-dihydroxybenzene.

U.S. Pat. No. 4,242,436 further discloses a method for obtaining old-time photographs (antique look photographs) according to the DTR-process. According to this method the photographic material is developed using a developing liquid that contains a mixture of iodide ions and a mercapto compound as a toning agents. However this method has the disadvantage that such developing liquid is unsuitable for developing other DTR-materials. As a further disadvantage, the reproduction of small details in the high density portion of the image is rather poor.

SUMMARY OF THE INVENTION

It is an object of the invention to provide an image receiving material and method for obtaining improved contone images having an antique look according to the silver salt diffusion transfer process.

Further objects of the invention will become clear from the description hereinafter.

According to the present invention there is provided an image receiving material comprising on a support an image receiving layer containing physical development nuclei characterised in that said image receiving material contains a nacreous pigment in said image receiving layer and/or in an optional layer between said support and said image receiving layer.

According to the present invention there is provided a method for obtaining contone images with an antique look comprising the steps of:

image-wise exposing an imaging element containing on a support a photosensitive layer containing a mixture of silver chloride and silver iodide and/or silver bromide dispersed in a hydrophillic colloid binder e.g. gelatin, wherein the silver chloride is present in an amount of at least 90 mole % based on the total mole of silver halide and wherein the weight ration of hydrophilic colloid to silver halide, expressed as silver nitrate, is between 3:1 and about 10:1 by weight and developing the thus obtained image-wise exposed imaging element in the presence of (a) silver halide solvent(s) and (a) developing agent(s) whilst in contact with an image receiving material as defined above.

DETAILED DESCRIPTION OF THE INVENTION

It has been found that contone images with an antique look can be obtained according to the silver salt diffusion transfer process without the need of special processing liquids using a nacreous pigment in the image receiving layer or a layer located between the support and the image receiving layer. It was further found that the reproduction of fine details in the high density part of the image was also much improved.

Nacreous pigments are commercially available materials and details relating to such pigments can be found, e.g. in Nacreous Pigments, L.M. Greenstein, Encyclopedia of Polymer Science and Technology, Vol. 10 (1969) p. 193–211 and in U.S. Pat. Nos. 3,331,669, 3,138,475, 3,123,490, 3.123.489, 3,071,482, 3,008,844 and 2,713,004, in "Colouration and colour enhancement of inks by nacreous pigments" by G. Houseman in the Journal of the Oil and Colour Chemist Assoc. Vol. 70 (1987) no. 11 p. 329–331 etc. For the purpose of the present invention, a suitable nacreous pigment is one which exhibits different light-reflecting characteristics when viewed from different angles and that can provide the image with the desired antique look.

Especially suitable nacreous pigments are Mica-pigments preferably provided with a coating of a metal oxide e.g. iron oxide, titanium oxide, chromium oxide etc.. Mica pigments are a group of hydrous aluminum silicate minerals with platy morphology and perfect basal (micaceous) cleavage. Examples of suitable micas are e.g. muscovite $KAl_2(AlSi_3O_{10})(OH)_2$, paragonite $NaAl_2(AlSi_3O_{10})(OH)_2$, phlogopite $K(Mg,Fe)(AlSi_3O_{10})(OH)_2$, biotite $K(Fe,Mg)(AlSi_3O_{10})(OH)_2$ and lepidolite $K(Li,Al)_{2.5-3.0}(Al_{1.0-0.5}Si_{3.0-3.5}O_{10})(OH)_2$ etc..

The surface dimensions of the nacreous pigments are preferably between 5 and 200μm and more preferably between 5 μm and 100 μm. The thickness of the nacreous pigment is preferably between 0.1 μm and 0.6 μm and more preferably between 0.2 μm and 0.4 μm.

According to the present invention the nacreous pigments are preferably incorporated in the image receiving layer of the image receiving material. However the nacreous pigments may also be present in one or more optional layers between the support and the image receiving layer. The nacreous pigments can not be present in a layer overlaying the image receiving layer because they would then cover the image formed in the image receiving layer which would yield images of poor quality. The nacreous pigments are preferably present in a total amount of 0.5 g/m$^2$ to 10 g/m$^2$ and more preferably between 1 g/m$^2$ and 3 g/m$^2$.

Suitable physical development nuclei for use in the image receiving material in accordance with the present invention are those commonly employed in the DTR-process e.g. noble metal nuclei e.g. silver, palladium, gold, platinum, sulphides, selenides or telurides of heavy metals e.g. PdS, $Ag_2S$, AgNiS, CoS etc.. Preferably used are PdS, $Ag_2S$ or AgNiS nuclei. The amount of nuclei used in the image receiving layer is preferably between 0.02 mg/m$^2$ and 10 mg/m$^2$.

The image receiving layer comprises for best imaging results the physical development nuclei in the presence of a protective hydrophilic colloid, e.g. gelatin and/or colloidal silica, polyvinyl alcohol etc..

Most of the DTR-positive materials now available on the market are composed of two or even three layers. Such materials normally contain on top of the nuclei containing layer, a layer which itself contains no nuclei and otherwise has the same composition as the nuclei containing layer and mainly serves to ensure good contact between the negative and positive material during transfer. Moreover, after drying this layer provides a protective coating for the image receiving layer containing the silver image. It further prevents bronzing or plumming of the black image areas in preventing the protruding of silver from the image receiving layer in the form of a glossy silver mirror (ref. the above mentioned book p. 50).

According to a preferred embodiment the processing liquid and/or the image-receiving element contains at least one image toning agent. In said case the image toning agent(s) may gradually transfer by diffusion from said image-receiving element into the processing liquid and keep therein the concentration of said agents almost steady. In practice such can be realized by using the silver image toning agents in a coverage in the range from 1 mg/m$^2$ to 20 mg/m$^2$ in a hydrophilic water-permeable colloid layer.

A survey of suitable toning agents is given in the above mentioned book of André Rott and Edith Weyde, p. 61–65, preference being given to 1-phenyl-1H-tetrazole-5-thiol, also called 1-phenyl-5-mercapto-tetrazole, tautomeric structures and derivatives thereof such as 1 -(2,3-dimethyl phenyl )-5-mercapto-tetrazole, 1-(3,4-dimethyl cyclohexyl )-5-mercapto-tetrazole, 1-(4-methylphenyl )-5-mercapto-tetrazole, 1-(3-chloro-4-methylphenyl)-5-mercapto-tetrazole, 1-(3,4-dichlorophenyl)-5-mercapto-tetrazole. Further particularly useful toning agents are of the class of thiohydantoins and of the class of phenyl substituted mercapto-triazoles. Still further toning agents suitable for use in accordance with the preferred embodiment of the present invention are the toning agents described in the European patent applications 218752, 208346, 218753 and U.S. Pat. No. 4,683,189.

The transfer behaviour of the complexed silver largely depends on the thickness of the image-receiving layer and the kind of binding agent or mixture of binding agents used in the nuclei containing layer. In order to obtain a sharp image with high spectral density the reduction of the silver salts diffusing into the image receiving layer must take place rapidly before lateral diffusion becomes substantial. An image-receiving material satisfying said purpose is described in U.S. Pat. No. 4,859,566.

An image-receiving material of this type is very suitable for use in connection with the present invention and contains a water-impermeable support coated with (1) an image-receiving layer containing physical development nuclei and nacreous pigments dispersed in a waterpermeable binder and (2) a waterpermeable top layer free from development nuclei and containing a hydrophilic colloid, in such a way that:

(i) the total solids coverage of said two layers (1) and (2) is at most 2 g/m$^2$, (ii) in layer (1) the coverage of the nuclei is in the range of 0.1 mg/m$^2$ to 10 mg/m$^2$, and the coverage of binder is in the range of 0.4 to 1.5 g/m$^2$, and (iii) in said top layer (2) the coverage of hydrophilic colloid is in the range of 0.1 to 0.9 g/m$^2$.

The coating of said layers proceeds preferably with slide hopper coater or curtain coater known to those skilled in the art.

According to a particular embodiment the nuclei containing layer (1) is present on a nuclei-free underlying hydrophilic colloid undercoat layer or undercoat layer system having a coverage in the range of 0.1 to 1 g/m$^2$ of hydrophilic colloid, the total solids coverage of layers (1) and (2) together with the undercoat being at most 2 g/m$^2$. In connection with this embodiment the nacreous pigments may be also be included in the undercoat layer or may be included therein instead of being present in the nuclei containing layer.

The undercoat optionally incorporates substances that improve the image quality, e.g. incorporates a substance improving the image-tone or the whiteness of the image background. For example, the undercoat may contain a fluorescent substance, silver complexing agent(s) and/or development inhibitor releasing compounds known for improving image sharpness.

According to a special embodiment the image-receiving layer (1) is applied on an undercoat playing the role of a timing layer in association with an acidic layer serving for the neutralization of alkali of the image-receiving layer. By the timing layer the time before neutralization occurs is established, at least in part, by the time it takes for the alkaline processing composition to penetrate through the timing layer. Materials suitable for neutralizing layers and timing layers are disclosed in Research Disclosure July 1974, item 12331 and July 1975, item 13525.

In the image-receiving layer (1) and/or in said top layer (2) and/or in an undercoat gelatin is used preferably as hydrophilic colloid. In layer (1) gelatin is present preferably for at least 60% by weight and is optionally used in conjunction with an other hydrophilic colloid, e.g. polyvinyl alcohol, cellulose derivatives, preferably carboxymethyl cellulose, dextran, gallactomannans, alginic acid derivatives, e.g. alginic acid sodium salt and/or watersoluble polyacrylamides. Said other hydrophilic colloid may be used also in the top layer for at most 10% by weight and in the undercoat in an amount lower than the gelatin content.

The image-receiving layer and/or a hydrophilic colloid layer in water-permeable relationship therewith may comprise a silver halide developing agent and/or silver halide solvent, e.g. sodium thiosulphate in an amount of approximately 0.1 g to approximately 4 g per m$^2$.

The image-receiving layer or a hydrophilic colloid layer in water-permeable relationship therewith may comprise colloidal silica.

The image-receiving layer may contain as physical development accelerators, in operative contact with the developing nuclei, thioether compounds such as those described e.g. in DE-A-1,124,354; U.S. Pat. No. 4,013,471; U.S. Pat. No. 4,072,526 and in EP 26520.

Preferably used supports for the image receiving material are paper supports e.g. polyethylene coated paper. Other supports that can be used are e.g. organic resin supports e.g. polycarbonate, polyester film, polystyrene, cellulose triacetate etc..

According to the method of the present invention for obtaining contone images with an antique look an image-wise exposed imaging element is developed in the presence of silver halide solvent(s) and developing agent(s) whilst in contact with an image receiving material as described above. After separation of both materials an antique look contone image is obtained.

An imaging element suited for use in the method of the present invention comprises on a support a hydrophillic colloid silver halide emulsion layer, wherein the silver halide comprises a mixture of silver chloride, and silver iodide and/or silver bromide, at least 90 mole % based on the total mole of the silver halide being silver chloride, and the ratio by weight of hydrophillic colloid to silver halide expressed as silver nitrate is between 3:1 and 10:1.

The binder for the silver halide emulsion layer and other optional layers contained on the imaging element is preferably gelatin. But instead of or together with gelatin, use can be made of one or more other natural and/or synthetic hydrophilic colloids, e.g. albumin, casein, zein, polyvinyl alcohol, alginic acids or salts thereof, cellulose derivatives such as carboxymethyl cellulose, modified gelatin, e.g. phthaloyl gelatin etc. The weight ratio in the silver halide emulsion layer of hydrophilic colloid binder to silver halide expressed as equivalent amount of silver nitrate to binder is in the range of 3:1 to 10:1 and more preferably between 3.5:1 and 6.7:1.

The silver halide emulsions may be coarse or fine grain and can be prepared by any of the well known procedures e.g. single jet emulsions, double jet emulsions such as Lippmann emulsions, ammoniacal emulsions, thiocyanate–or thioether–ripened emulsions such as those described in U.S. Pat. No. 2,222,264, 3,320,069, and 3,271,157. Surface image emulsions may be used or internal image emulsions may be used such as those described in U.S. Pat. No. 2,592,250, 3,206,313, and 3,447,927. If desired, mixtures of surface and internal image emulsions may be used as described in U.S. Pat. No. 2,996,382.

The silver halide-particles of the photographic emulsions may have a regular crystalline form such as cubic or octahedral form or they may have a transition form. Regular-grain emulsions are described e.g. in J. Photogr. Sci., Vol. 12, No. 5, Sept./Oct. 1964, pp. 242–251. The silver halide grains may also have an almost spherical form or they may have a tabular form (so-called T-grains), or may have composite crystal forms comprising a mixture of regular and irregular crystalline forms. The silver halide grains may have a multilayered structure having a core and shell of different halide composition. Besides having a differently composed core and shell the silver halide grains may comprise also different halide compositions and metal dopants inbetween.

The average size expressed as the average diameter of the silver halide grains may range from 0.2 to 1.2 $\mu$m, preferably between 0.2 $\mu$m and 0.8 $\mu$m, and most preferably between 0.3 $\mu$m and 0.6 $\mu$m. The size distribution can be homodisperse or heterodispere. A homodisperse size distribution is obtained when 95% of the grains have a size that does not deviate more than 30% from the average grain size.

The emulsions can be chemically sensitized e.g. by adding sulphur-containing compounds during the chemical ripening stage e.g. allyl isothiocyanate, allyl thiourea, and sodium thiosulphate. Also reducing agents e.g. the tin compounds described in BE-A 493,464 and 568,687, and polyamines such as diethylene triamine or derivatives of aminomethane-sulphonic acid can be used as chemical sensitizers. Other suitable chemical sensitizers are noble metals and noble metal compounds such as gold, platinum, palladium, iridium, ruthenium and rhodium. This method of chemical sensitization has been described in the article of R. KOSLOWSKY, Z. Wiss. Photogr. Photophys. Photochem. 46, 65–72 ( 1951).

The emulsions can also be sensitized with polyalkylene oxide derivatives, e.g. with polyethylene oxide having a molecular weight of 1000 to 20,000, or with condensation products of alkylene oxides and aliphatic alcohols, glycols, cyclic dehydration products of hexitols, alkyl-substituted phenols, aliphatic carboxylic acids, aliphatic amines, aliphatic diamines and amides. The condensation products have a molecular weight of at least 700, preferably of more than 1000. It is also possible to combine these sensitizers with each other as described in BE-A 537,278 and GB-A 727,982.

The silver halide emulsion may be sensitized panchromatically to ensure reproduction of all colours of the visible part of the spectrum or it may be orthochromatically sensitized.

The spectral photosensitivity of the silver halide can be adjusted by proper spectral sensitization by means of the usual mono- or polymethine dyes such as acidic or basic cyanines, hemicyanines, oxonols, hemioxonols, styryl dyes or others, also tri- or polynuclear roethine dyes e.g. rhodacyanines or neocyanines. Such spectral sensitizers have been described by e.g. F.M. HAMER in "The Cyanine Dyes and Related Compounds" (1964) Interscience Publishers, John Wiley & Sons, N.Y.

The silver halide emulsions may contain the usual stabilizers e.g. homopolar or salt-like compounds of mercury with aromatic or heterocyclic rings such as mercaptotriazoles, simple mercury salts, sulphonium mercury double salts and other mercury compounds. Other suitable stabilizers are azaindenes, preferably tetra- or penta-azaindenes, especially those substituted with hydroxy or amino groups. Compounds of this kind have been described by BIRR in Z. Wiss. Photogr. Photophys. Photochem. 47, 2–27 (1952). Other suitable stabilizers are i.a. heterocyclic mercapto compounds e.g. phenylmercaptotetrazole. quaternary benzothiazole derivatives, and benzotriazole.

The silver halide emulsions may further contain either or not in combination with one or more developing agents pH controlling ingredients, and other ingredients such as antifogging agents, development accelerators, wetting agents, and hardening agents for gelatin.

The silver halide emulsion coated side of the photographic material can be provided with a top layer that contains hydrophilic colloids that form a waterpermeable layer. Its nature is such that it does not inhibit or restrain the diffusion transfer of the complexed silver but acts e.g. as an anti-stress layer. Appropriate hydrophilic binding agents for such top layer are e.g. gelatin, methyl cellulose, the sodium salt of carboxymethyl cellulose, hydroxyethyl cellulose, hydroxyethyl starch, hydroxypropyl starch, sodium alginate, gum tragacanth, starch, polyvinyl alcohol, polyacrylic acid, polyacrylamide, poly-N-vinyl pyrrolidinone, polyoxyethylene, and copoly(methylvinylether/maleic acid). The thickness of this layer depends on the nature of the colloid used and the required mechanical strength. Such layer if present may be transferred at least partially to the image-receiving layer without deleterious action on the image formation.

Suitable supports for an imaging element in accordance with the present invention are supports that can be made e.g. of cellulose triacetate, polyvinyl chloride, polycarbonates, polystyrene or polyesters such as polyethylene terephthalate being provide with a suitable subbing layer(s) for adhering thereto a hydrophilic colloid layer. Other suitable supports are paper supports preferably coated with a resin e.g. polyethylene.

An imaging element for use in the method according to the present invention may contain other additional layers in water permeable relationship with the silver halide emulsion layer. It is especially advantageous to include a base-layer between the support and the photosensitive silver halide emulsion layer. In a preferred embodiment of the present invention said base-layer serves as an anti halation layer so that the reflectance of the support containing said antihalation layer is not more than 25% and preferably not more than 15%. This layer can therefore contain the same light-absorbing dyes as described above for the emulsion layer; as alternative finely divided carbon black can be used for the same antihalation purposes as described in U.S. Pat. No. 2,327,828. Alternatively the support it self may be selected such that it can serve as antihalation means as described in e.g. U.S. Pat. No. 4.165.237. On the other hand, in order to gain sensitivity, light reflecting pigments, e.g. titaniumdioxide can be present. Further this layer can contain hardening agents, matting agents, e.g. silica particles, and wetting agents. At least part of these matting agents and/or light reflection pigments may also be present in the silver halide emulsion layer the most part however preferably being present in said base-layer. As a further alternative the light reflecting pigments may be present in a separate layer provided between the antihalation layer and the photosensitive silver halide emulsion layer.

The side of the support of the imaging element opposite to the side containing the photosensitive layer may be coated with one or more backing layers to avoid curling of the imaging element. Such backing layer preferably comprises a hydrophilic colloid e.g. gelatin or one of the hydrophilic colloids disclosed above and may further comprise ingredients such as e.g. silica, silver halide solvents, toning agents, etc..

The hydrophilic layers of the photographic element and image receiving layer, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxydioxan, active vinyl compounds e.g. 1,3,5-triacryloylhexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts of the type, described in U.S. Pat. No. 4,063,952.

Processing of the image-wise exposed imaging element whilst in contact with an image receiving material according to the invention is accomplished using an alkaline processing liquid having a pH preferably between 9 and 13. The pH of the alkaline processing liquid may be established using various alkaline substances. Suitable alkaline substances are inorganic alkali e.g. sodium hydroxide, potassium carbonate or alkanolamines or mixtures thereof. Preferably used alkanolamines are tertiary alkanolamines e.g. those described in EP-A-397925, EP-A-397926, EP-A-397927, EP-A-398435 and U.S. Pat. No. 4.632.896. A combination of alkanolamines having both a $pk_a$ above or below 9 or a combination of alkanolamines whereof at least one has a $pk_a$ above 9 and another having a $pk_a$ of 9 or less may also be used as disclosed in the Japanese patent applications laid open to the public numbers 73949/61, 73953/61, 169841/61, 212670/60, 73950/61, 73952/61, 102644/61, 226647/63, 229453/63, U.S. Pat. No. 4,362,811, U.S. Pat. No. 4,568,634 etc.. The concentration of these alkanolamines is preferably from 0.1 mol/l to 0.9 mol/l.

Suitable developing agents for the exposed silver halide are e.g. hydroquinone-type and 1-phenyl-3-pyrazolidone-type developing agents as well as p-monomethylaminophenol and derivatives thereof. Preferably used is a combination of a hydroquinone-type and 1-phenyl-3-pyrazolidone-type developing agent wherein the latter is preferably incorporated in one of the layers comprised on the support of the photographic material. A preferred class of 1-phenyl-3-pyrazolidone-type developing agents is disclosed in the European patent application number 449340. According to a preferred embodiment a mixture of developing agents comprising an o-dihydroxybenzene, e.g. catechol, a 3-pyrazolidinone e.g. a 1-aryl-3-pyrazolidinone and optionally a p-dihydroxybenzene, e.g. hydroquinone the molar amount of the o-dihydroxybenzene in said mixture being larger than the molar amount of the 3-pyrazolidinone, and the p-dihydroxybenzene if any being present in a molar ratio of at most 5% with respect to the o-dihydroxybenzene can be used. Other type of developing agents suitable for use in accordance with the present invention are reductones e.g. ascorbic acid derivatives. Such type of developing agents are disclosed in the European patent application number 91200311.8.

The developing agent or a mixture of developing agents can be present in an alkaline processing solution, in the photographic material or the image receiving material. In case the developing agent or a mixture of developing agents is contained in the photographic material and/or image receiving material, the processing solution can be merely an aqueous alkaline solution that initiates and activates the development.

According to the present invention the imaging element is developed in the presence of a silver halide solvent. Preferably used silver halide solvents are water soluble thiosulphate compounds such as ammonium and sodium thiosulphate, or ammonium and alkali metal thiocyanates. Other useful silver halide solvents (or "complexing agents") are described in the book "The Theory of the Photographic Process" edited by T.H. James, 4th edition, p. 474–475 (1977), in particular sulphites and uracil. Further interesting silver halide complexing agents are cyclic iraides, preferably combined with alkanolamines, as described in U.S. Pat. No. 4,297,430 and U.S. Pat. No. 4,355,090. 2-mercaptobenzoic acid derivatives are described as silver halide solvents in U.S. Pat. No. 4,297,429, preferably combined with alkanolamines or with cyclic imides and alkanolamines. Dialkylmethylenedisulfones can also be used as silver halide solvent.

The silver halide solvent is preferably present in the processing solution but may also be present in one or more layers comprised on the support of the imaging element and/or receiving material. When the silver halide solvent is incorporated in the photographic material it may be incorporated as a silver halide solvent precursor as disclosed in e.g. Japanese published unexamined patent applications no. 15247/59 and 271345/63, U.S. Pat. No. 4,693,955 and U.S. Pat. No. 3,685,991.

The processing solution for use in accordance with the present invention may comprise other additives such as e.g. thickeners, preservatives, detergents e.g. acetylenic detergents such as SURFYNOL 104, SURFYNOL 465, SURFYNOL 440 etc. all available from Air Reduction Chemical Company N.Y.

The DTR-process is normally carried out at a temperature in the range of 10° C. to 35° C.

The present invention will now be illustrated by the following example without however limiting it thereto. All parts are by weight unless otherwise specified.

EXAMPLE 1

Imaging element

A gelatino silver halide emulsion was prepared by slowly running with stirring an aqueous solution of I mole of silver nitrate per liter into a gelatin solution containing per mole of silver nitrate 41 g of gelatin, 1.2 mole of sodium chloride, 0.08 mole of potassium bromide and 0.01 mole of potassium iodide.

The temperature during precipitation and the subsequent ripening process lasting three hours was kept at 40° C.

Before cooling, shredding and washing 214 g of gelatin were added per mole of silver halide. The washed noodles were molten and another 476 g of gelatin were added per mole of silver halide during the chemical ripening. After ripening 285 g of gelatin in the form of a 20% aqueous solution were added to the emulsion per mole of silver halide as well as hydroquinone in an amount such that after coating 0.9 g of hydroquinone were present per $m^2$ and 1-phenyl-4,4-dimethyl-3-pyrazolidinone in an amount such that 0.21 g thereof were present per $m^2$. The emulsion was coated at one side of a subbed water-resistant paper support consisting of a paper having a weight of 110 g/$m^2$ coated at both sides with a polyethylene stratum at a ratio of 20 g/$m^2$ per side.

The emulsion was coated in such a way that an amount of silver equivalent to 1.5 g of silver nitrate was applied per $m^2$. The amount of gelatin corresponding therewith is 8.93 g/$m^2$ since the gelatin to silver nitrate weight ratio was 5.97.

Image receiving material A (comparison)

One side of a paper support having a weight of 110 g/$m^2$ and being coated at both sides with a polyethylene layer was coated at a dry coverage of 2 g/$m^2$ with an image-receiving layer containing silver-nickel sulphide nuclei and gelatin. This layer was applied by slide hopper coating so that the nuclei were in an undermost coating of 1.3 g gelatin per $m^2$ and a top layer was provided of 0.7 g of gelatin per $m^2$.

Image receiving material B (invention)

An image receiving material was prepared similar to image receiving material A with the exception that 2.1 g/$m^2$ of a nacreous pigment (IRIDDIN 300 Gold Pearl available from Merck) was included in the image receiving layer.

| Composition of the processing liquid: | |
|---|---|
| hydroxyethyl cellulose (g) | 1.0 |
| Ethylenediaminetetraacetic acid tetrasodium salt (g) | 2.0 |
| $Na_2SO_3$ (g) | 45.0 |
| $Na_2S_2O_3$ (g) | 14.0 |
| KBr (g) | 0.5 |
| 1-Phenyl-5-mercapto-tetrazole (g) | 0.1 |
| 1-(3,4-Dichlorophenyl)-1H-tetrazole-5-thiol (g) | 0.02 |
| N-methyl-ethanolamine (ml) | 45.0 |
| N-methyl-diethanolamine (ml) | 30.0 |

-continued

| Composition of the processing liquid: | |
|---|---|
| Water up to | 1 l |

Two imaging elements as described above were image-wise exposed to a continuous tone wedge in a reflex camera. The exposed imaging elements were pre-moistened with the above described processing liquid, the contact time with said liquid being 6 seconds before being pressed together with one of the image-receiving materials as defined above. The transfer processor employed was a COPYPROOF (registered trade name of AGFA-GEVAERT N.V. ) type CP 380. The transfer contact time was 15 seconds.

Only with image receiving material B an antique look was obtained and furthermore the reproduction of fine detail in the high density portions of the image was increased with respect to image receiving material A.

We claim:

1. An image receiving material comprising on a support an image receiving layer containing physical development nuclei characterised in that said image receiving material contains a nacreous pigment in said image receiving layer and/or in an optional layer between said support and said image receiving layer.

2. An image receiving material according to claim 1 wherein said nacreous pigment is a mica pigment coated with a metal oxide.

3. An image receiving material according to claim 1 or 2 wherein said nacreous pigment is present in an amount between 0.5 $g/m^2$ and 10 $g/m^2$.

4. An image receiving material according to claim 1 wherein the surface dimensions of said nacreous pigment are between 5 $\mu m$ and 200 $\mu m$ and wherein the thickness of said nacreous pigments is between 0.1 $\mu m$ and 0.6 $\mu m$.

5. A method for obtaining a contone image having an antique look comprising the steps of:

image-wise exposing an imaging element containing on a support a photosensitive layer containing a mixture of silver chloride and silver iodide and/or silver bromide dispersed in a hydrophillic colloid binder wherein the silver chloride is present in an amount of at least 90 mole % based on the total mole of silver halide and wherein the weight ratio of hydrophillic colloid to silver halide, expressed as silver nitrate, is between 3:1 and about 10:1 by weight and developing the thus obtained image-wise exposed imaging element in the presence of (a) silver halide solvent(s) and (a) developing agent(s) whilst in contact with an image receiving material comprising on a support an image receiving layer containing physical development nuclei characterised in that said image receiving material contains a nacreous pigment in said image receiving layer and/or in an optional layer between said support and said image receiving layer.

6. A method according to claim 5 wherein said nacreous pigment is a mica pigment coated with a metal oxide.

7. A method according to claim 5 wherein said nacreous pigment is present in an amount between 0.5 $g/m^2$ and 10 $g/m^2$.

8. A method according to claim 5 wherein the surface dimensions of said nacreous pigment are between 5 $\mu m$ and 200 $\mu m$ and wherein the thickness of said nacreous pigments is between 0.1 $\mu m$ and 0.6 $\mu m$.

* * * * *